US007464030B1

(12) United States Patent
Maeda et al.

(10) Patent No.: US 7,464,030 B1
(45) Date of Patent: Dec. 9, 2008

(54) VECTOR SEARCH METHOD

(75) Inventors: Yuji Maeda, Tokyo (JP); Shuichi Maeda, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/048,076

(22) Filed: Mar. 26, 1998

(30) Foreign Application Priority Data

Mar. 28, 1997 (JP) ..... P09-078615

(51) Int. Cl.
*G10L 19/00* (2006.01)

(52) U.S. Cl. ..... 704/222; 704/230

(58) Field of Classification Search ..... 704/219, 704/220, 222, 230, 221, 238
See application file for complete search history.

(56) References Cited

U.S. PATENT DOCUMENTS 4,817,157 A * 3/1989 Gerson ..... 704/230
4,896,361 A * 1/1990 Gerson ..... 704/222
5,519,806 A 5/1996 Nakamura
5,633,982 A * 5/1997 Ganesan et al. ..... 704/233

FOREIGN PATENT DOCUMENTS

EP 0501420 9/1992
EP 0516439 12/1992
EP 06 02954 6/1994

OTHER PUBLICATIONS

Popescu et al. (CELP Coding Using Trellis-Coded Vector Quantization of the Excitation); IEEE Trans actions on speech and audio processing, vol. 3, No. 6, pp. 464-472, 1995.*
Chan et al. (Efficient codebook search procedure for vector-sum excited liner predective coding of speech); Electronics Letters, vol. 30, No. 22, pp. 1830-1831, Oct. 1994.*
I. Gerson et al., *Vector Sum Excited Linear Prediction*, Advances in Speech Coding, pp. 69-79 (Jan. 1, 1991).

* cited by examiner

*Primary Examiner*—David R. Hudspeth
*Assistant Examiner*—Abul K. Azad
(74) *Attorney, Agent, or Firm*—Jay H. Maioli

(57) ABSTRACT

Each of the M basic vectors in a noise code book 260 is multiplied by a factor ±1 in a sign adder 270 and combined in an adder 280 to create $2^M$ noise signed vectors. The characteristic of the binary Gray code is utilized as follows. A change $\Delta G_u$ obtained between a noise signed vector based on a signed word i of the binary Gray code and a noise sign vector based on a sign word u adjacent to the sign word i and different from the sign word i only in a predetermined bit position v is used in such a manner that a sign word u' which is next to reverse the bit position v on the Gray code sequence can express a change $\Delta G_{u'}$ from the noise signed vector by utilizing the fact that the sign word u' differs from the sign word u only in one bit position w excluding the bit position V. Thus, calculation is simplified, increasing the vector search speed.

5 Claims, 8 Drawing Sheets

| N | BIT V<br>4 3 2 1 |
|---|---|
| 0 | 0 0 0 0 |
| 1 | 0 0 0 1 |
| 2 | 0 0 1 1 |
| 3 | 0 0 1 0 |
| 4 | 0 1 1 0 |
| 5 | 0 1 1 1 |
| 6 | 0 1 0 1 |
| 7 | 0 1 0 0 |
| 8 | 1 1 0 0 |
| 9 | 1 1 0 1 |
| 10 | 1 1 1 1 |
| 11 | 1 1 1 0 |
| 12 | 1 0 1 0 |
| 13 | 1 0 1 1 |
| 14 | 1 0 0 1 |
| 15 | 1 0 0 0 |

425

426

FIG.4

(PRIOR ART)

FIG.6A

| M | MULTIPLICATION | | |
|---|---|---|---|
| | PRESENT INVENTION | CONVENTIONAL | RATIO |
| 4 | 57 | 90 | 0.633 |
| 5 | 118 | 248 | 0.475 |
| 6 | 231 | 630 | 0.367 |
| 7 | 444 | 1524 | 0.291 |
| 8 | 853 | 3570 | 0.239 |

FIG.6B

| M | ADDITION AND SUBTRACTION | | |
|---|---|---|---|
| | PRESENT INVENTION | CONVENTIONAL | RATIO |
| 4 | 49 | 45 | 1.089 |
| 5 | 103 | 124 | 0.831 |
| 6 | 207 | 315 | 0.657 |
| 7 | 409 | 762 | 0.537 |
| 8 | 805 | 1785 | 0.451 |

FIG.6C

| M | WRITING TO MEMORY | | |
|---|---|---|---|
| | PRESENT INVENTION | CONVENTIONAL | RATIO |
| 4 | 30 | 15 | 2.0 |
| 5 | 62 | 31 | 2.0 |
| 6 | 126 | 63 | 2.0 |
| 7 | 254 | 127 | 2.0 |
| 8 | 510 | 255 | 2.0 |

VECTOR SEARCH METHOD

BACKGROUND OF THE INVENTION

1. Field of the Invention

The present invention relates to a vector search method for obtaining an optimal sound source vector in vector quantization in compressing to code an audio signal and an acoustic signal.

2. Description of the Prior Art

Various coding methods are known for compressing an audio signal and an acoustic signal by utilizing statistic features in the time region and frequency band as well as the hearing sense characteristics. These coding methods can be divided into a time region coding, a frequency region coding, an analysis-synthesis coding, and the like.

For an effective coding method for compressing to encode an audio signal and the like, there are known a sine wave analysis coding such as harmonic coding and multiband excitation (MBE) coding as well as sub-band coding (SBC), linear predictive coding (LPC), discrete cosine transform (DCT), modified DCT (MDCT), fast Fourier transform (FFT), and the like.

When coding an audio signal, it is possible to predict a present sample value from a past sample value, utilizing the fact that there is a correlation between adjacent sample values. Adaptive predictive coding (APC) utilizes this characteristic and carries out a coding of a difference between a predicted value and an input signal, i.e., a prediction residue.

In this adaptive prediction coding, an input signal is fetched in a coding unit in which an audio signal can be regarded as almost stationary, for example, in a frame unit of 20 ms, and a linear prediction is carried out according to a prediction coefficient obtained by the linear prediction coding (LPC), so as to obtain a difference between the predicted value and the input signal. This difference is quantized and multiplexed with the prediction coefficient and the quantization step width as auxiliary information, so as to be transmitted in a frame unit.

Next, explanation will be given on code excited linear prediction (CELP) coding as a representative predictive coding method.

The CELP coding uses a noise dictionary called a codebook from which an optimal noise is selected to express an input audio signal and its number (index) is transmitted. In the CELP coding, a closed loop using analysis by synthesis (AbS) is employed for vector quantization of a time axis waveform, thus coding a sound source parameter.

FIG. 1 is a block diagram showing a configuration of an essential portion of a coding apparatus for coding an audio signal by using the CELP. Hereinafter, explanation will be given on the CELP coding with reference to the configuration of this coding apparatus.

An audio signal supplied from an input terminal 10 is firstly subjected to the LPC (linear predictive coding) analysis in an LPC analyzer 20, and a prediction coefficient obtained is transmitted to a synthesis filter 30. Moreover, the prediction coefficient is also transmitted to a multiplexer 130.

In the synthesis filter 30, the prediction coefficient from the LPC analyzer 20 is synthesized with signed vectors supplied from an adaptive code book 40 and a noise codebook 60, which will be detailed later, through amplifiers 50 and 70 and an adder 80.

An adder 90 determines a difference between the audio signal supplied from the input terminal 10 and a prediction value from the synthesis filter 30, which is transmitted to a hearing sense weighting block 100.

In the hearing sense weighting block 100, the difference obtained in the adder 90 is weighted, considering the characteristics of the hearing sense of a human. An error calculator 110 searches a signed vector to minimize a distortion of the difference weighted by the hearing sense, i.e., a difference between the prediction value from the synthesis filter 30 and the input audio signal, and gains of the amplifiers 50 and 70. The result of this search is transmitted as an index to the adaptive codebook 40, the noise codebook 60, and a gain codebook 120 as well as to the multiplexer 130 so as to be transmitted as a transmission path sign from an output terminal 140.

Thus, an optimal signed vector to express the input audio signal is selected from the adaptive codebook 40 and the noise codebook 60, and the optimal gain is determined for synthesizing them. It should be noted that the aforementioned synthesizing can be carried out after the hearing-sense weighting of the audio signal supplied from the input terminal 10, and signed vectors stored in the codebooks may be hearing-sense weighted.

Next, explanation will be given on the aforementioned adaptive codebook 40, the noise codebook 60, and the gain codebook 120.

In the CELP coding, a sound source vector for expressing an input audio signal is formed as a linear sum of a signed vector stored in the adaptive codebook 40 and a signed vector stored in the noise codebook 60. Here, the indexes of the respective codebooks used to express the sound source vector minimizing the hearing-sense weighted difference from the input signal vector are determined by calculating the output vector of the synthesis filter 30 for all the signed vectors stored and calculating errors in the error calculator 110.

Moreover, the gain of the adaptive codebook in the amplifier 50 and the gain of the noise codebook in the amplifier 70 are also coded by way of a similar search.

The noise codebook 60 normally contains a series of vectors of the Gaussian noise with dispersion 1 as the codebook vectors powered by the number of bits. And normally, a combination of the codebook vectors is selected so as to minimize the distortion of the sound source vector obtained by adding an appropriate gain to these codebook vectors.

The quantization distortion when quantizing the selected codebook vectors can be reduced by increasing the number of dimensions of the codebook. For example, the codebook used is in 40 dimensions and 2 to the power of 9 (the number of bits), i.e., 512 terms.

By using this CELP coding, it is possible to obtain a comparatively high compression ratio and a preferable sound quality. However, the use of a codebook of a large number of dimensions requires a large calculation amount in the synthesis filter and a large memory amount in the codebook, which makes difficult a real-time processing. If a high sound quality is to be assured, a great delay is caused. Moreover, there is another problem that only a one bit error in the code brings about a completely different vector reproduced. That is, such a coding is weak for the sign error.

In order to improve the aforementioned problems of the CELP coding, vector sum excited linear prediction (VSELP) coding is employed. Hereinafter, this VSELP coding will be explained with reference to FIG. 2 and FIG. 3.

FIG. 2 is a block diagram showing a configuration of a noise codebook used in a coding apparatus for coding an audio signal by way of the VSELP.

The VSELP coding employs a noise codebook 260 consisting of a plurality of predetermined basic vectors. Each of the number M of basic vectors stored in the noise codebook 260 is multiplied by a factor +1 or −1 to reverse the value according to the index decoded with a code additional section 270-1 to 270-M by a decoder 210. The M basic vectors multiplied by the factor +1 or −1 are combined with one another in an adder 280 to create $2^M$ noise signed vectors.

As a result, by carrying out a convolution calculation for the M basic vectors and addition and subtraction thereof, it is possible to obtain a convolution calculation result for all the noise signed vectors. Moreover, as only the M basic vectors should be stored in the noise codebook 260, it is possible to reduce the memory amount. Also, it is possible to enhance the durability for a sign error because the $2^M$ noise signed vectors created have a redundant configuration which can be expressed by addition and subtraction of the basic vectors.

FIG. 3 is a block diagram showing a configuration of an essential portion of a VSELP coding apparatus having the aforementioned noise codebook. In this VSELP coding apparatus, the number of noise codebooks which is normally 512 in the ordinary CELP coding apparatus is reduced to 9, and each of the signed vectors (basic vectors) is added with a sign +1 or −1 by a sign adder 365, so that a linear sum of these is obtained in an adder 370, so as to create $2^9$=512 noise signed vectors.

The main feature of the VSELP coding is as has been described above that a noise signed vector is formed as a linear sum of basic vectors and that the gain of the adaptive codebook and the gain of the noise codebook are vector-quantized at once.

The basic configuration of such a VSELP coding is a coding method of analysis by way of synthesis, i.e., carrying out a linear prediction synthesis of a pitch frequency component and a noise component as the excitation sources. That is, a waveform is selected in vector unit from an adaptive codebook 340 which depends on a pitch frequency of an input audio signal and a noise codebook 360 for carrying out a linear prediction synthesis, so as to select a signed vector and a gain which minimize the difference from the waveform of the input audio signal.

In the VSELP coding, a signed vector from the adaptive codebook expressing the pitch component of an input audio signal and a signed vector from the noise codebook expressing the noise component of the input audio signal are both vector-quantized, so as to simultaneously obtain two optimal parameters in combination.

In this process, as the basic vector has only the freedom of being added by +1 or −1 and the vector of the adaptive codebook is not orthogonal to the basic vector, the coding efficiency is lowered if the CELP procedure is employed to successively determine the vector of the adaptive codebook and the gain of the noise signed vector. To cope with this, in the VSELP, the basic vector sign is determined according to a procedure as follows.

Firstly, the pitch frequency of the input audio signal is searched to determine a signed vector of the adaptive codebook. Next, the noise basic vector is projected to a space orthogonal to the signed vector of the adaptive codebook and an inner product with the input vector is calculated, so as to determine the signed vector of the noise codebook.

Next, according to the two signed vectors determined, the codebook is searched to determine a combination of a gain β and a gain γ which minimizes the difference between the vector synthesized and the input audio signal. For quantization of the two gains, a pair of two parameters equally converted is used. Here, the β corresponds to a long-term prediction gain coefficient and the γ corresponds to a scalar gain of the signed vector.

Although the calculation amount for the codebook search in the VSELP coding is lower than the calculation amount in the CELP coding, it is desired to further improve the processing speed, further reducing the delay.

SUMMARY OF THE INVENTION

It is therefore an object of the present invention to simplify the codebook search in the vector quantization when coding an audio signal or the like, enabling improvement of the vector search speed.

In order to achieve the aforementioned object, in the vector search method according to the present invention wherein among prediction vectors obtained according to synthetic vectors obtained by synthesizing a plurality of basic vectors each multiplied by a factor +1 or −1, such a prediction vector is determined that makes minimum a difference from a given input vector or makes maximum an inner product with the given input vector. The calculation to obtain the difference from the input vector or the inner product with the input vector is carried out by changing the combinations of the aforementioned factors multiplied for each of the plurality of basic vectors, according to the Gray code, so that an intermediate value Gu obtained from a synthetic vector created according to the Gray code u is expressed by an intermediate value Gi based on i adjacent to the Gray code u and a change DGu between them.

Furthermore, the combination of the basic vectors which makes minimum the difference between the input vector and the prediction vector or makes maximum an inner product between them is obtained by using a difference between a change of the synthetic vector when a predetermined bit position of the Gray code is changed and a change of the synthetic vector when a different bit position is changed.

According to the aforementioned vector search method, by utilizing the characteristic of the Gray code, it is possible to use a calculation result obtained for carrying out the next calculation, thus enabling an increase in the vector search speed.

BRIEF DESCRIPTION OF THE DRAWINGS

FIG. 4 shows an example of the binary Gray code.

FIG. 6 shows a calculation amount and a memory write amount in the vector search method according to the present invention in comparison to the conventional vector search.

DETAILED DESCRIPTION OF PREFERRED EMBODIMENTS

Figure 1:
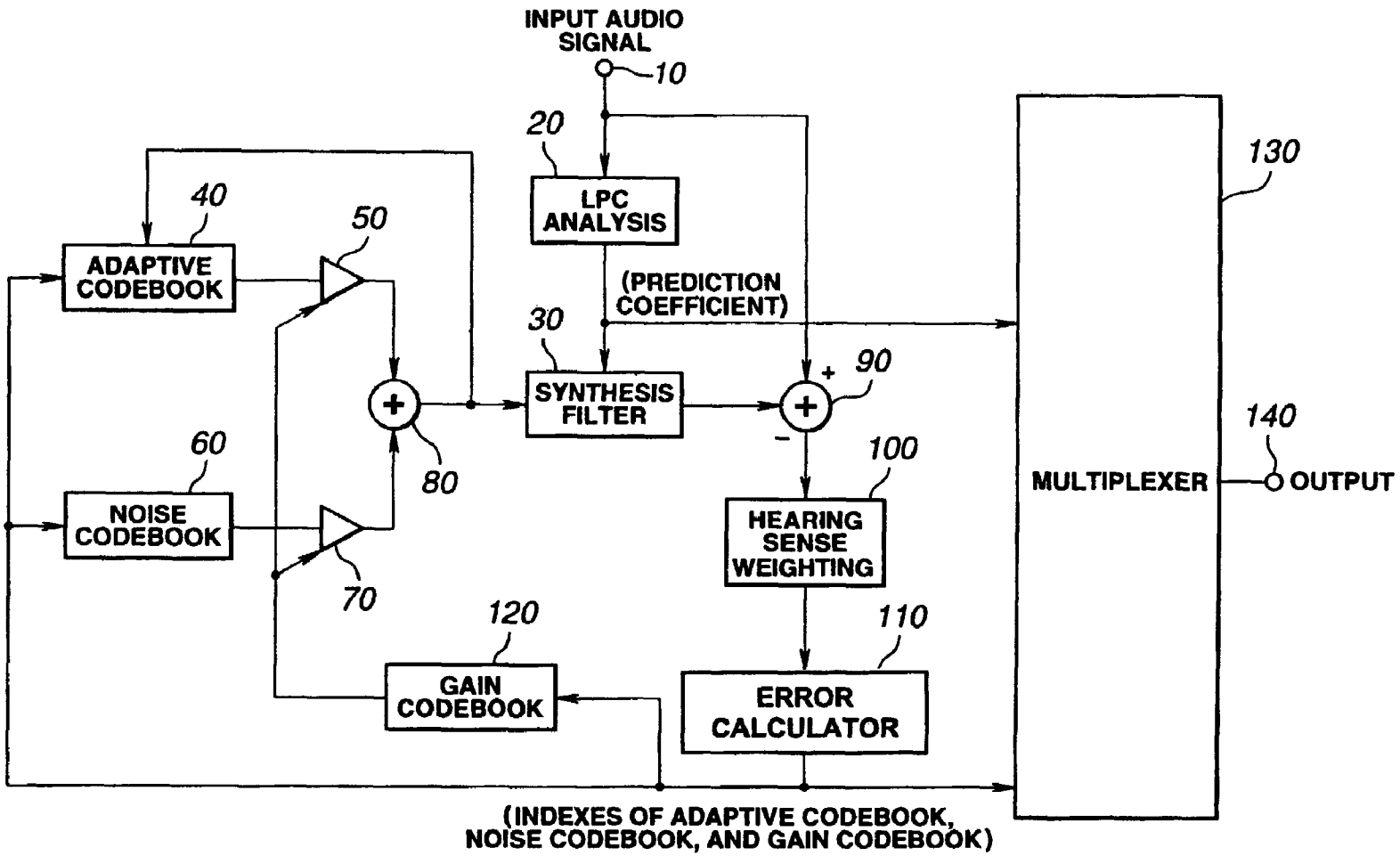
FIG.1 (PRIOR ART)
FIG. 1 is a block diagram showing a configuration example of a coding apparatus for explanation of the CELP coding.
Figure 2:
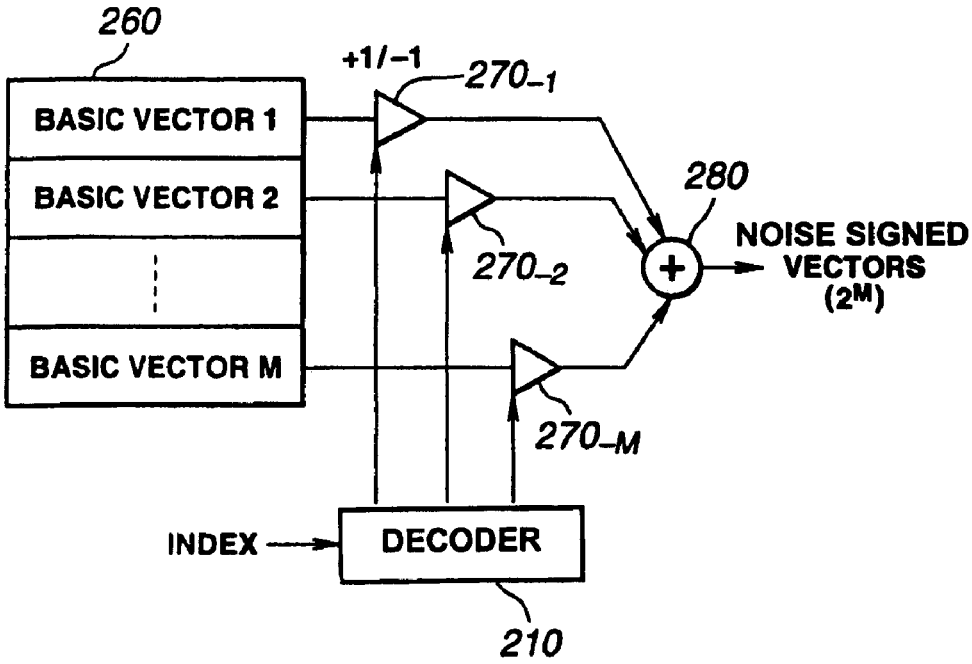
FIG.2 (PRIOR ART)
FIG. 2 is a block diagram showing the configuration of the noise codebook used in the VSELP coding.
Figure 3:
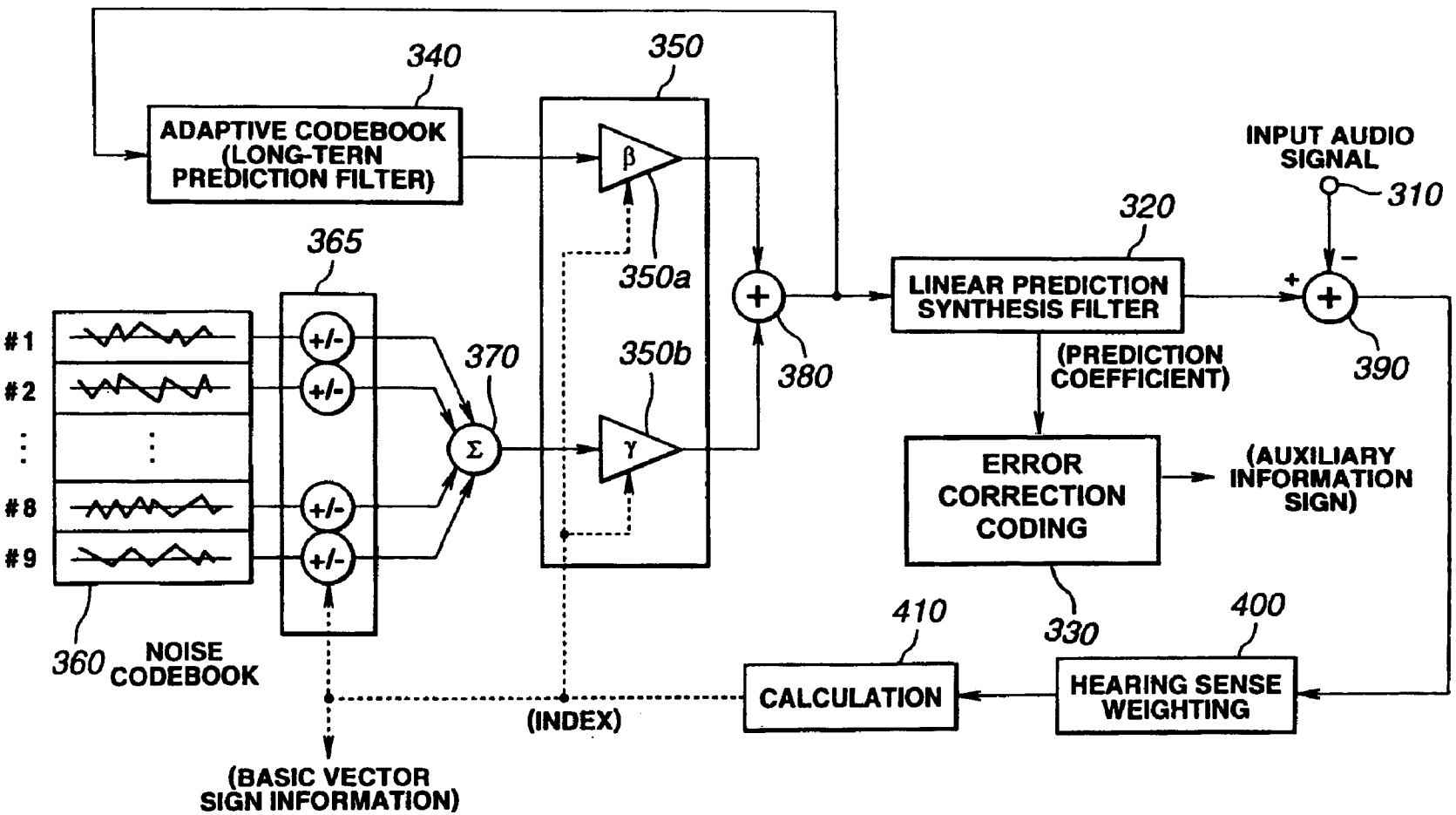
FIG.3 (PRIOR ART)
FIG. 3 is a block diagram showing a configuration example of a coding apparatus for explanation of the VSELP coding.

Description will now be directed to the vector search method according to preferred embodiments of the present invention.

Firstly, explanation will be given on a case of vector quantization carried out in the aforementioned VSELP coding apparatus.

In the waveform coding and analysis-synthesis system, instead of quantizing respective sample values of waveform and spectrum envelope parameters, a plurality of values in combination (vector) are expressed as a whole with a single sign. Such a quantization method is called vector quantization. In coding by way of waveform vector quantization, after a waveform is sampled it is cut out for a predetermined time interval as a coding unit and a waveform pattern during the interval is expressed by a single sign. For this, various waveform patterns are stored in memory in advance and a sign is added to them. The correspondence between the sign and the patterns (signed vector) is indicated by a codebook.

For an audio signal waveform, a comparison is made with each of the parameters stored in the codebook for the respective time intervals and a sign of the waveform having the highest similarity is used to express the waveform of the interval. Thus, various input sounds are expressed with a limited number of patterns. Consequently, appropriate patterns to minimize the entire distortion are stored in the codebook, considering the pattern distribution and the like.

The vector quantization can be a highly effective coding based on the facts that the patterns to be realized have various specialties such that a correlation can be seen between sample points in a certain interval of an audio waveform and the sample points are smoothly connected.

Next, explanation will given on the vector search for searching a signed vector which minimizes the difference between an input vector and a synthesized vector formed from an optimal combination of a plurality of vectors selected from the codebook.

Firstly, it is assumed that p (n) is an input audio signal weighted with the hearing sense and $q'_m$ (n) ($1 \leqq m \leqq M$) is a basic vector orthogonal to a long-term prediction vector weighted with the hearing sense.

Expression (1) gives an inner product of the input vector and the synthesized vector formed by a combination of a plurality of vectors selected from the codebook. That is, by obtaining $\theta_{ij}$ which makes the Expression (1) maximum, the inner product between the synthesized vector and the input vector becomes maximum.

It should be noted that the combination $\theta_{ij}$ is −1 if the bit j of the sign word i is 0, and 1 if the bit j of the sign word i is 1 ($0 \leqq i \leqq 2^m - 1$, $1 \leqq m \leqq M$).

$$\frac{\left(\sum_{n=0}^{N-1}\sum_{m=1}^{M}\theta_{im}q_m^l(n)p(n)\right)^2}{\sum_{n=0}^{N-1}\left(\sum_{m=1}^{M}\theta_{im}q_m^l(n)\right)^2} - \text{Max.} \tag{1}$$

The denominator of the Expression (1) can be developed to obtain Expression (2).

$$2\sum_{n=0}^{N-1}\sum_{j=2}^{M}\sum_{m=1}^{f-1}\theta_{im}\theta_{ij}q_m^l(n)q_j^l(n) + \sum_{n=0}^{N-1}\sum_{m=1}^{M}q_m^l(n)^2 \tag{2}$$

Here, a variable $R_m$ given by Expression (3) and a variable $D_{mj}$ given by Expression (4) are introduced.

$$R_m = 2\sum_{n=0}^{N-1} q_m^l(n)p(n) \tag{3}$$

$$D_{mj} = 4\sum_{n=0}^{N-1} q_m^l(n)q_j^l(n) \tag{4}$$

These variables $R_m$ and $D_{mj}$ are introduced into Expression (1) to obtain Expression (5).

$$\frac{\left(\frac{1}{2}\sum_{m=1}^{M}\theta_{im}R_m\right)^2}{\frac{1}{2}\sum_{j=2}^{M}\sum_{m=1}^{j-1}\theta_{im}\theta_{ij}D_{mj} + \frac{1}{4}\sum_{m=1}^{M}D_{mm}} \tag{5}$$

Next, a variable $C_i$ given by Expression (6) and a variable $G_i$ given by Expression (7) are further introduced.

$$C_i = \frac{1}{2}\sum_{m=1}^{M}\theta_{im}R_m \tag{6}$$

$$G_i = \frac{1}{2}\sum_{j=2}^{M}\sum_{m=1}^{j-1}\theta_{im}\theta_{ij}D_{mj} + \frac{1}{4}\sum_{m=1}^{M}D_{mm} \tag{7}$$

By using these variables $C_i$ and $G_i$, Expression (1) can be rewritten into Expression (8). That is, by obtaining the variables $C_i$ and $G_i$ to maximize the Expression (8), it is possible to make maximum the correlation between the synthesized vector and the input vector.

$$C_i^2/G_i - \text{Max.} \tag{8}$$

By the way, if there is a sign word u which is different from the sign word i only in the bit position v, and if $C_i$ and $G_i$ are known, then $C_u$ and $G_u$ can be expressed by Expressions (9) and (10).

$$Cu = C_i + \theta_{uv}R_v \tag{9}$$

$$G_u = G_i + \sum_{j=1}^{v-1}\theta_{uj}\theta_{uv}D_{jv} + \sum_{j=v+1}^{M}\theta_{uj}\theta_{uv}D_{jv} \tag{10}$$

By utilizing this and by converting the sign word i by using the binary Gray code, it is possible to calculate with a high efficiency the optimal combination of a plurality of signed vectors selected from the codebook. Note that the Gray code will be detailed later.

The Expression (10) can be rewritten into Expression (11) if $\Delta G_u$ is assumed to be a change from $G_i$ to Gu.

$$\Delta G_u = \sum_{j=1}^{v-1}\theta_{uj}\theta_{uv}D_{jv} + \sum_{j=v+1}^{M}\theta_{uj}\theta_{uv}D_{jv} \tag{11}$$

Here, the sign word u' of the binary Gray code differs from the sign word i only in the bit position V. The sign word u' differs from the preceding sign word u only in one bit other than the bit position v.

Now, if w is assumed to be the aforementioned bit position, the sign of $\theta_{uv}$ is reversed and the relationship of Expression (12) can be obtained from the Expression (11).

$$\Delta G_{u'} = -\Delta G_u + 2\theta_{uw}\theta_{uv}D_{wv} \tag{12}$$

From this, it is possible to use the Expression (11) to obtain the change $\Delta G_u$ when the bit position V has changed firstly in the binary Gray code and the Expression (12) to obtain the change at the same bit position V after that, thus enhancing the vector search speed.

FIG. 4 shows the binary Gray code when M=4. As shown here, the Gray code is a kind of cyclic code in which two adjacent sign words differ from each other only in one bit.

Here, if attention is paid to the bit position V=3, for example, the value is changed when N changes from 3 to 4 as indicated by a reference numeral 425 and when N changes from 11 to 12 as indicated by a reference numeral 426. That is, if the Gray code when N=4 is compared to the Gray code when N=12, the only difference is in the bit w (W=4), excluding the bit v (V=3).

Here, if it is assumed that the Gray code when N=4 is u, and the Gray code when N=12 is u', then $$\text{When N=4: } \theta_{u1}=-1,\ \theta_{u2}=1,\ \theta_{u3}=1,\ \theta_{u4}=-1$$

$$\text{When N=12: } \theta_{u'1}=-1,\ \theta_{u'2}=1,\ \theta_{u'3}=-1,\ \theta_{u'4}=1 \tag{13}$$

From this and the Expression (11), the following can be obtained.

$$\text{When N=4: } \Delta G_u = \theta_{u3}\{\theta_{u1}D_{13}+\theta_{u2}D_{23}+\theta_{u4}D_{43}\}$$

$$\text{When N=12: } \Delta G_{u'} = \theta_{u'3}\{\theta_{u'1}D_{13}+\theta_{u'2}D_{23}+\theta_{u'4}D_{43}\} \tag{14}$$

As has been described above, because the bit position V=1 and 2 are with an identical sign and the bit position V=3 and 4 are with different signs, the following are satisfied.

$$\begin{aligned}\Delta G_{u'} &- \theta_{u3}\{\theta_{u1}D_{13}+\theta_{u2}D_{23}+(-\theta_{u4})D_{43}\} \qquad (15a)\\ &= -\theta_{u3}\{\theta_{u1}D_{13}+\theta_{u2}D_{23}+\theta_{u4}D_{43}\}+2\theta_{u3}\theta_{u4}D_{43}\\ &= -\Delta G_u + 2\theta_{u3}\theta_{u4}D_{43} \qquad (15b)\end{aligned}$$

That is, the Expression (15a) can be simplified into the Expression (15b).

Figure 5:
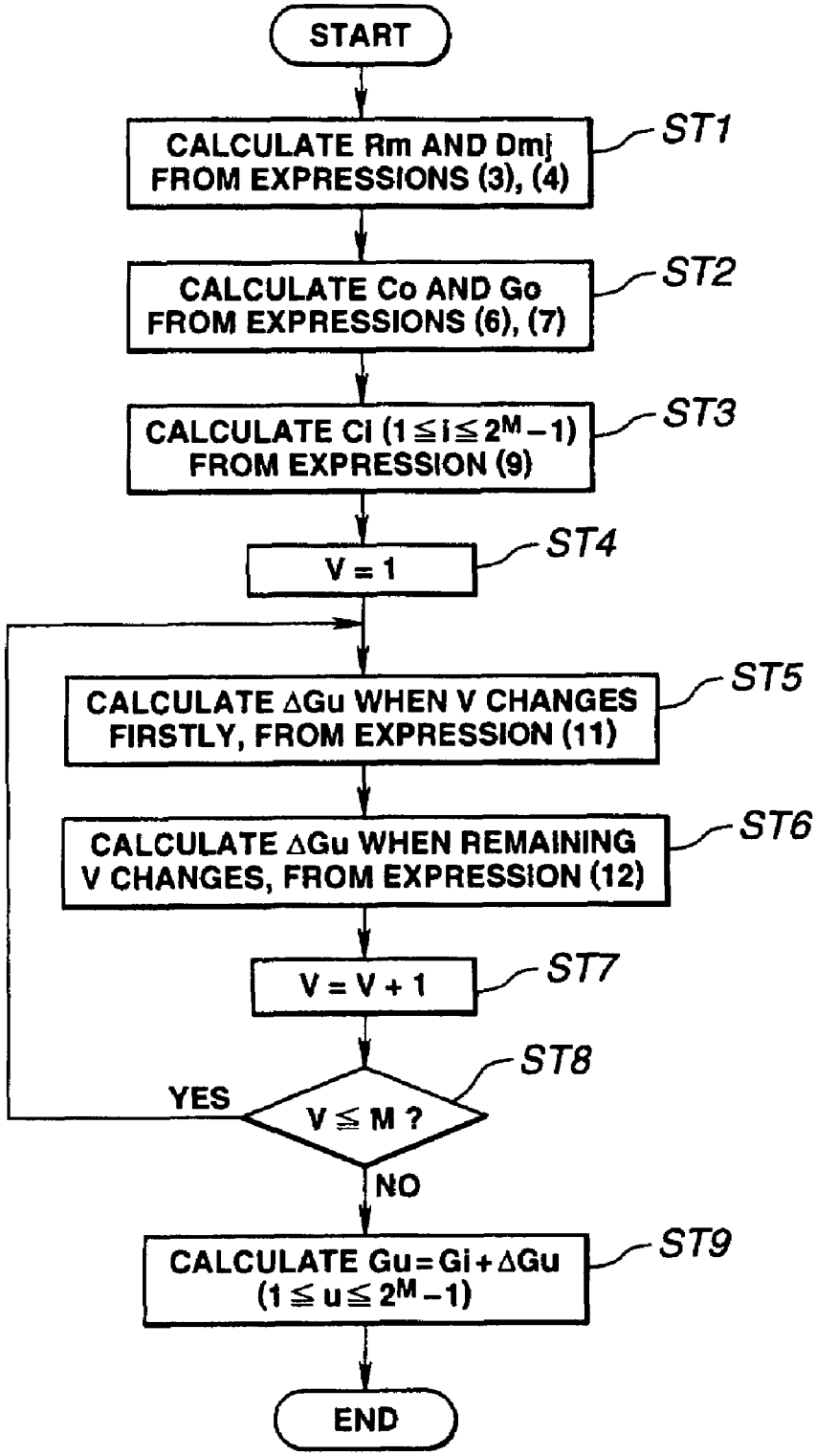
FIG. 5 is a flowchart showing a procedure of the vector search method according the present invention.

FIG. 5 is a flowchart showing the aforementioned procedure of the vector search method according to the present invention.

Firstly, in step ST1, the variable $R_m$ is calculated from the Expression (3), and the variable $D_{mj}$, from the Expression (4).

In step ST2, the variable $C_0$ is calculated from the Expression (6), and the variable $G_0$, from the Expression (7).

In step ST3, $C_i$ ($1 \leqq i \leqq 2^{Mn}-1$) is calculated from the Expression (9).

In step ST4, the bit V=1 is calculated.

In step ST5, the change amount $\Delta G_u$ of $G_u$ when a certain bit V firstly changes is calculated from the Expression (11).

In step ST6, the $\Delta G_u$ when the remaining bit V changes is calculated from the Expression (12).

In step ST7, the bit V is set to V+1.

In step ST8, it is determined whether the V is equal to or less than M. If V is equal to or less than M, control is returned to step ST5 to repeat the aforementioned procedure. On the other hand, if V is greater than M, control is passed to step ST9.

In step ST9, $G_u = G_1 + \Delta G_u$ (wherein $1 \leqq u \leqq 2^{Mn}-1$) is calculated, completing the vector search.

FIG. 6 shows the $G_1$ calculation processing amount obtained by the vector search method according to the present invention in comparison to the processing of the conventional vector search method.

FIG. 6A shows the comparison result in the number of calculations for multiplication. Moreover, FIG. 6B shows the comparison results in the number of calculations for the addition and subtraction. From these results, it can be seen that as the M increases, the number of calculations is reduced.

Moreover, FIG. 6C shows the comparison result in the number of times writing into memory. This result shows that the number of times writing into memory is doubled in comparison to the conventional vector search method, regardless of the M value.

Next, explanation will be given on the vector search method according to an embodiment of the present invention employed in vector quantization in the PSI-CELP coding.

The PSI-CELP (pitch synchronous innovation CELP) coding is a highly effective audio coding for obtaining an improved sound quality for the sound-existing portion by periodicity processing signed vectors from the noise codebook with a pitch periodicity (pitch lag) of the adaptive codebook.

Figure 7:
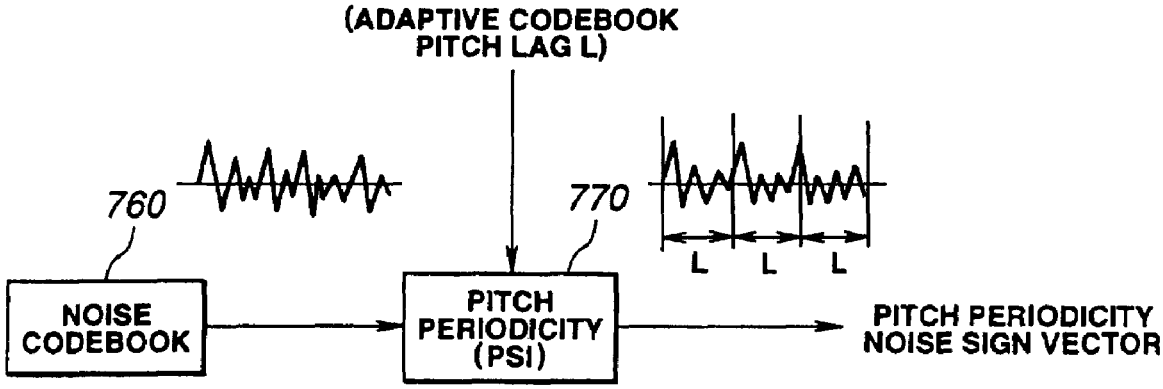
FIG. 7 explains the PSI-CELP.

FIG. 7 schematically shows the periodicity processing of the pitch of a signed vector from the noise codebook. In the aforementioned CELP coding, the adaptive codebook is used for effectively expressing an audio signal containing a periodic pitch component. However, when the bit rate is lowered to the order of 4 kbs, the number of bits assigned for the sound source coding is decreased and it becomes impossible to sufficiently express the audio signal containing a periodic pitch component with the adaptive codebook alone.

To cope with this, in the PSI-CELP coding system, the pitch of the signed vector from the noise codebook 760 is subjected to periodicity processing. This enables to accurate expression of the audio signal containing a periodic pitch component which cannot be sufficiently expressed by the adaptive codebook alone. It should be noted that the lag (pitch lag) L represents a pitch cycle expressed in the number of samples.

Figure 8:
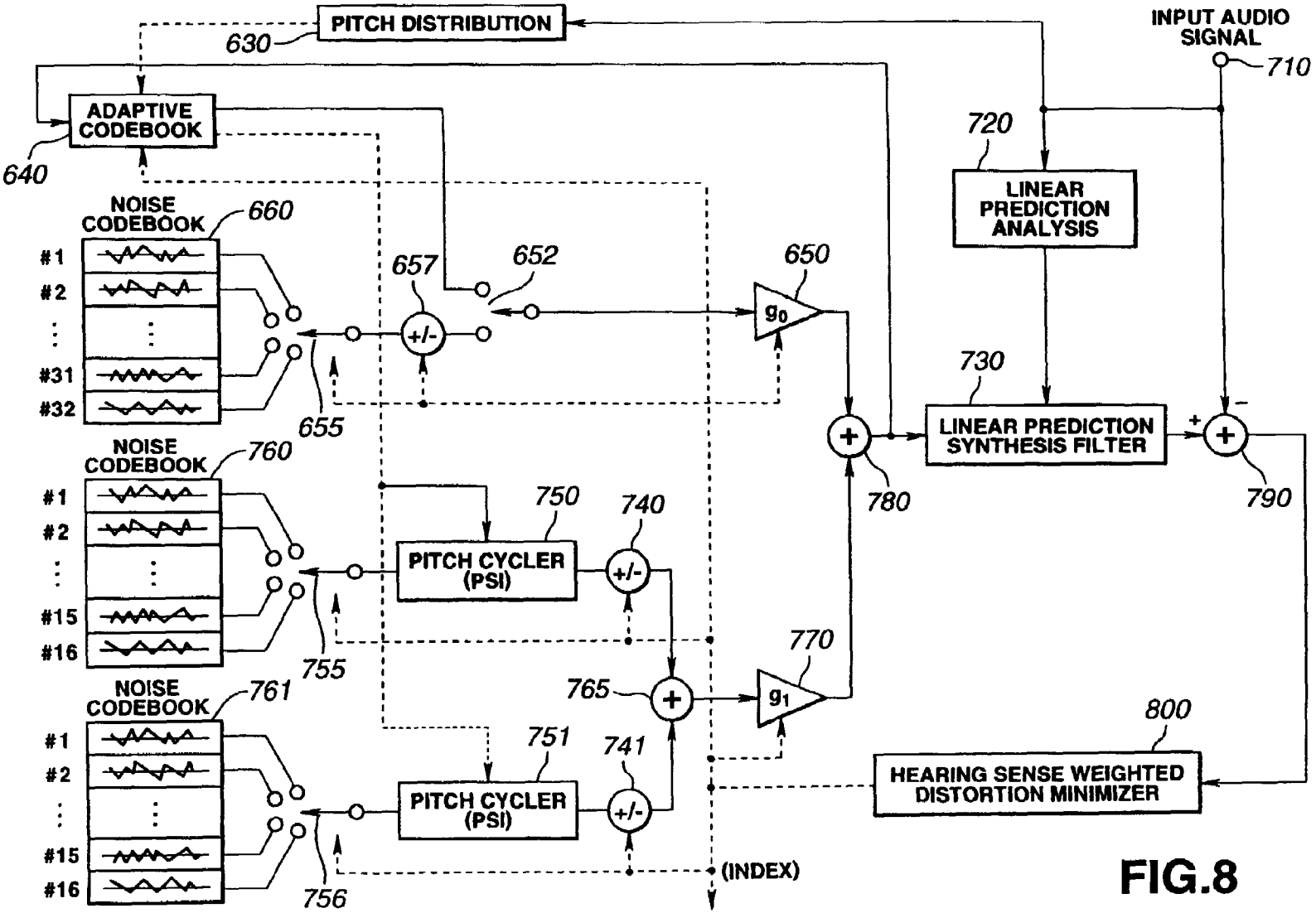
FIG. 8 is a block diagram showing a configuration example of a coding apparatus for explanation of the PSI-CELP coding.

FIG. 8 is a block diagram showing a configuration example of an essential portion of a PSI-CELP coding apparatus. Hereinafter, explanation will be given on this PSI-CELP coding with reference to FIG. 8.

The PSI-CELP coding is characterized by carrying out the pitch periodicity processing of the noise codebook. This periodicity processing is to deform an audio signal by taking out only a pitch periodic component which is a basic cycle of the audio signal so as to be repeated.

An audio signal supplied from an input terminal 710 is firstly subjected to a linear prediction analysis in a linear prediction analyzer 720 and a prediction coefficient obtained is fed to a linear prediction synthesis filter 730. In the synthesis filter 730 the prediction coefficient from the linear prediction analyzer 720 is synthesized with signed vectors supplied from an adaptive codebook 640 and noise codebooks 660, 760, and 761 respectively via amplifiers 650 and 770 and an adder 780.

The noise signed vector from the noise codebook 660 is a vector selected from 32 basic vectors by a selector 655 and multiplied by a factor +1 or −1 by a sign adder 657. The noise signed vector multiplied by the factor +1 or −1 and the signed vector from the adaptive codebook 640 are selected by a selector 652 and added with a predetermined gain g0 by the amplifier 650 so as to be supplied to the adder 780.

On the other hand, the noise signed vectors from the noise codebooks 760 and 761 are selected respectively from 16 basic vectors by selectors 755 and 756 and subjected to pitch periodicity processing by pitch cyclers 750 and 751, after which they are multiplied by a factor +1 or −1 by sign adders 740 and 741 so as to be supplied to an adder 765. After this, they are given a predetermined gain $g_1$ in the amplifier 770 and supplied to the adder 780.

The signed vectors which have been given a gain respectively by the amplifiers 650 and 770 are added in the adder 780 and supplied to the linear prediction synthesis filter 730.

In an adder 790, a difference is obtained between the audio signal supplied from the input terminal 710 and the prediction value from the linear prediction synthesis filter 730.

In a hearing sense weighting distortion minimizer 800, the difference obtained by the adder 790 is subjected to hearing sense weighting, considering the human hearing sense characteristics. The difference weighted with the hearing sense, i.e., a signed vector and a gain) are determined to minimize a difference error between the prediction value from the linear prediction synthesis filter 730 and the input audio signal. The results are transmitted as an index to the adaptive codebook 640, the noise codebooks 660, 760, and 761, and outputted as a transmission path sign.

By the way, in the LSP middle band second stage quantization, the Expression (16) gives a Euclid distance between the synthesized vector made from a combination of a plurality of vectors selected from codebooks and the input middle band LSP error vector. That is, this calculation is carried out by obtaining a pair θ(k, i) which minimizes the Euclid distance $D(k)^2$ given by the Expression (16), wherein it is assumed that $0 \leqq k \leqq MM-1$ and $0 \leqq i \leqq 7$.

$$D(k)^2 = \sum_{j=0}^{7}\left(lspe(k, j) - \sum_{i=0}^{7}\theta(k, i)C_{LSPM2}(i, j)\right)^2 \tag{16}$$

This Expression (16) is developed into Expression (17) as follows.

$$D(k)^2 = \sum_{j=0}^{7} lspe(k, j)^2 - 2\sum_{i=0}^{7}\theta(k, i)\sum_{j=0}^{7} lspe(k, j)C_{LSPM2}(i, j) + 2\sum_{i=0}^{7}\sum_{m=i+1}^{7}\theta(k, i)\theta(k, m)\sum_{j=0}^{7} C_{LSPM2}(i, j)C_{LSPM2}(m, j) + \sum_{i=0}^{7}\sum_{j=0}^{7} C_{LSPM2}(i, j)^2 \tag{17}$$

Here, a variable R(k, i) ($0<k<MM-i$, $0<i<7$) given by Expression (18) and a variable D (i, m) ($0<i$, $m<7$ given by Expression (19) are introduced.

$$R(k, i) = 2\sum_{j=0}^{7} lspe(k, j)C_{LSPM2}(i, j) \tag{18}$$

$$D(i, m) = 4\sum_{j=0}^{7} C_{LSPM2}(i, j)C_{LSPM2}(m, j) \tag{19}$$

In the Expression (17), the first term of the right side is always constant and accordingly can be ignored. By substituting the aforementioned variables R and D, it is necessary to obtain θ(k, i) which satisfies the relationship defined by Expression (20) as follows.

$$-\sum_{i=0}^{7}\theta(k, i)R(k, i) + \frac{1}{2}\sum_{i=0}^{7}\sum_{m=i+1}^{7}\theta(k, i)\theta(k, m)D(i, m) + \frac{1}{4}\sum_{i=0}^{7}D(i, i) - \text{Min.} \tag{20}$$

Here, a variable $C_I$ given by Expression (21) and a variable $G_I$ given by Expression (22) are further introduced (wherein $0 \leqq I \leqq 2^8-1$).

$$C_I = \frac{1}{2}\sum_{i=0}^{7}\theta(k, i)R(k, i) \tag{21}$$

$$G_I = \frac{1}{2}\sum_{i=0}^{7}\sum_{m=i+1}^{7}\theta(k, i)\theta(k, m)D(i, m) + \frac{1}{4}\sum_{i=0}^{7}D(i, i) \tag{22}$$

The aforementioned variables $C_I$ and $G_I$ are introduced into the Expression (20) to obtain the following.

$$-2*C_I+G_I-\text{Min.} \tag{23}$$

That is, it is possible to minimize the error by obtaining the variables $C_I$ and $G_I$ which minimize the Expression (23).

In the aforementioned vector search in the PSI-CELP coding system, Expressions (21) and (22) have identical forms as the Expressions (9) and (10) in the aforementioned vector search in the VSELP coding. Consequently, the aforementioned vector search method according to the present invention can also be applied to the PSI-CELP, enhancing the vector search speed.

The vector search method according to the present invention, utilizing the Gray code characteristic, uses a result of a calculation which has been complete, for carrying out the next calculation, thus enabling simplification of the calculation of the synthesized vector and an increase in the vector search speed.

What is claimed is:

1. A vector search method for obtaining an optimal sound source vector in vector quantization, in which a difference error between a prediction vector and an input vector is calculated in such a way that combinations of factors respectively multiplied by a plurality of basic vectors are changed according to the Gray code, the method comprising the steps of:

obtaining an intermediate value Gu by calculation of a synthetic vector created according to a sign word u of the Gray code;

expressing said value Gu by an intermediate value Gi, obtained by calculation of a synthetic vector created according to an adjacent sign word i different from said sign word u only in a predetermined bit position v, and a change ΔGu calculated by utilizing the Gray code characteristic;

using said ΔGu to express a change ΔGu' between an intermediate value Gi' according to another sign word i' in said Gray code and an intermediate value Gu' according to an adjacent sign word u' different from said sign word i' only in a predetermined bit position v; and using said intermediate value Gi and said change ΔGu' to obtain said optimal sound source vector.

2. The vector search method as claimed in claim 1, wherein said prediction vector is created through a prediction synthesis filter by synthesizing said synthetic vector and a vector based on a past signal from a sound source.

3. The vector search method as claimed in claim 1, wherein said sign word u' in said Gray code differs from said sign word u only in one bit position w, excluding the predetermined bit position v, and said change ΔGu' is expressed as a sum of said change ΔGu already obtained according to said sign word u of said Gray code and a difference between said change ΔGu and said change ΔGu'.

4. The vector search method as claimed in claim 1, wherein the calculating of the difference error between said prediction vector and said input vector includes minimizing said difference error and is a calculation to determine a synthetic vector from synthetic vectors created by synthesizing basic vectors for the sign word i of the Gray code that maximizes an inner product with said input vector, and said inner product is expressed by using two variables Ci and Gi, as $Ci^2/Gi$, whose value is made maximum.

5. The vector search method as claimed in claim 1, wherein the calculating of the difference error between said prediction vector and said input vector includes minimizing said difference error and is a calculation to determine a synthetic vector from synthetic vectors created by synthesizing basic vectors for the sign word i of the Gray code that minimizes a Euclidian distance from said input vector, and said Euclidian distance is expressed by a sum of two variables Ci and Gi, which sum is minimized.

* * * * *